US012467255B2

(12) United States Patent
Kaji et al.

(10) Patent No.: US 12,467,255 B2
(45) Date of Patent: Nov. 11, 2025

(54) PARTITIONING STORAGE RACK AND BUILDING

(71) Applicant: SEKISUI HOUSE, LTD., Osaka (JP)

(72) Inventors: Ayako Kaji, Osaka (JP); Ayaka Hirose, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 376 days.

(21) Appl. No.: 17/637,984

(22) PCT Filed: Aug. 13, 2020

(86) PCT No.: PCT/JP2020/030740
§ 371 (c)(1),
(2) Date: Feb. 24, 2022

(87) PCT Pub. No.: WO2021/039411
PCT Pub. Date: Mar. 4, 2021

(65) Prior Publication Data

US 2022/0282478 A1 Sep. 8, 2022

(30) Foreign Application Priority Data

Aug. 30, 2019 (JP) ..... 2019-157565
Aug. 30, 2019 (JP) ..... 2019-157570

(51) Int. Cl.
*E04B 2/74* (2006.01)
*A47B 63/00* (2006.01)
(Continued)

(52) U.S. Cl.
CPC ..... *E04B 2/74* (2013.01)

(58) Field of Classification Search
CPC ..... E04B 2/74
(Continued)

(56) References Cited

U.S. PATENT DOCUMENTS 1,536,518 A * 5/1925 Osborn ..... E04B 2/7407 52/67
1,675,269 A * 6/1928 Hine ..... A47B 57/583 211/184
(Continued)

FOREIGN PATENT DOCUMENTS

CN 207700754 U * 8/2018
DE 1254327 B * 11/1967 ..... E04B 2/74
(Continued)

OTHER PUBLICATIONS

Renovation of a living space with a goodatmosphere that leaves a taste, [online] , Jul. 20, 2018, Internet<URL :https://www.homify.jp/ideabooks/5609914/
味わいを残す雰囲気のいい住空間リノベーション> >.
(Continued)

*Primary Examiner* — Brian D Mattei
*Assistant Examiner* — Joseph J. Sadlon
(74) *Attorney, Agent, or Firm* — CANTOR COLBURN LLP

(57) ABSTRACT

A partitioning storage rack includes a storage unit that that can store articles. The storage unit includes a plurality of first type storage units that are configured so that one side of the storage unit is visible from the other side, and a second type storage unit that is configured so that the one side of the storage unit is not visible from the other side. The plurality of first type storage units differ from each other in location in the height direction of the partitioning storage rack.

16 Claims, 6 Drawing Sheets

(51) Int. Cl.
*E04B 2/00* (2006.01)
*E04H 1/02* (2006.01)

(58) Field of Classification Search
USPC ..... 52/220.7
See application file for complete search history.

(56) References Cited

U.S. PATENT DOCUMENTS 1,755,589 A * 4/1930 Brown ..... A47B 63/00 108/110
1,783,703 A * 12/1930 Crowell ..... A47B 63/00 211/134
1,831,163 A * 11/1931 Crowell ..... E04B 2/7403 52/363
2,023,989 A * 12/1935 Donald ..... E04B 2/7407 52/762
2,658,810 A * 11/1953 Ellis ..... E04B 2/7435 312/238
2,766,855 A * 10/1956 Johnson ..... E04B 2/76 52/290
3,043,642 A * 7/1962 Nelson ..... A47B 96/1425 248/200.1
3,096,130 A * 7/1963 Mccobb ..... A47B 77/02 312/111
3,180,459 A * 4/1965 Liskey, Jr. ..... E04B 2/7437 52/584.1
3,528,715 A * 9/1970 Gilmore, Jr. ..... A47B 63/00 312/330.1
3,531,898 A * 10/1970 Facemire ..... E04H 3/10 52/27
3,538,977 A * 11/1970 Alexandre ..... E04B 2/74 160/202
3,571,999 A * 3/1971 Downing ..... G09F 15/0068 40/605
3,644,009 A * 2/1972 Tyler ..... A47F 3/002 206/387.11
3,703,325 A * 11/1972 Schnarr ..... A47B 63/00 312/307
3,732,650 A * 5/1973 Gwilliam ..... E04B 1/04 52/220.2
3,733,755 A * 5/1973 Butler ..... E04B 2/7854 211/187
3,750,354 A * 8/1973 Boros ..... E04H 1/04 52/220.2
3,769,502 A * 10/1973 Schultz ..... A47C 21/00 362/228
3,839,834 A * 10/1974 Goddard ..... E04B 2/74 52/63
3,841,727 A * 10/1974 Peng ..... A47B 87/0284 190/7
3,884,001 A * 5/1975 Tylius ..... E04B 1/04 52/185
3,927,498 A * 12/1975 Benedetti ..... E04B 1/6812 52/262
3,983,672 A * 10/1976 Dietrich ..... E04B 2/74 109/82
4,034,864 A * 7/1977 Tyson ..... A47B 63/00 211/50
4,165,588 A * 8/1979 Bayley ..... A47B 47/05 52/36.5
4,288,948 A * 9/1981 Harris ..... E04H 3/04 D6/699
4,360,991 A * 11/1982 West ..... E04B 2/7416 49/70
4,433,880 A * 2/1984 Maravelas, Jr. ..... A47F 5/0018 D6/675.1
4,471,586 A * 9/1984 Shuch ..... E04H 1/1222 52/36.2
4,472,912 A * 9/1984 Pipp ..... E04H 3/04 52/28
4,535,577 A * 8/1985 Tenser ..... E04B 2/7429 174/495
4,563,047 A * 1/1986 Braunschweig ..... A47B 63/00 108/92
4,571,907 A * 2/1986 DeFouw ..... A47B 83/001 52/239
4,596,097 A * 6/1986 Stewart ..... E04H 1/02 52/185
4,706,422 A * 11/1987 Ashton ..... E04B 2/7411 52/799.12
4,763,581 A * 8/1988 Weese ..... A47B 83/00 108/92
4,771,583 A * 9/1988 Ball ..... E04B 2/7433 52/239
4,799,743 A * 1/1989 Kikuchi ..... A47B 77/02 312/196
4,817,538 A * 4/1989 Michaelsen ..... A47B 57/34 211/184
4,840,000 A * 6/1989 Grines ..... A47C 1/11 297/344.1
4,874,027 A * 10/1989 Boundy ..... A47B 83/001 160/218
4,914,873 A * 4/1990 Newhouse ..... A47B 13/021 52/79.9
5,016,764 A * 5/1991 Bauer ..... A47B 47/04 248/57
5,038,539 A * 8/1991 Kelley ..... H02G 3/288 211/208
5,067,287 A * 11/1991 Lewis ..... G09B 5/06 434/408
5,070,667 A * 12/1991 Schulte ..... E04H 1/1205 52/584.1
5,106,173 A * 4/1992 Kelley ..... A47B 47/02 312/111
5,177,917 A * 1/1993 del Castillo Von Haucke ..... E04B 2/7409 52/236.7
5,307,596 A * 5/1994 Bockmiller ..... F16B 37/045 52/36.5
5,314,221 A * 5/1994 Hammer ..... B25J 1/04 294/209
5,325,641 A * 7/1994 Felton ..... E04B 2/7409 52/36.5
5,346,296 A * 9/1994 Kelley ..... A47B 21/06 312/265.6
5,394,658 A * 3/1995 Schreiner ..... E04B 2/7422 312/196
5,403,232 A * 4/1995 Helm ..... E04B 2/7433 454/903
5,423,604 A * 6/1995 Chern ..... A47B 47/005 312/265.5
5,511,675 A * 4/1996 Frederick ..... A47B 63/00 211/94.01
5,626,404 A * 5/1997 Kelley ..... E05D 15/58 312/198
D384,227 S * 9/1997 Grosfillex ..... D6/675.1
5,692,342 A * 12/1997 Devlin, Jr. ..... A47F 10/00 52/36.2
5,715,760 A * 2/1998 Frascaroli ..... A47B 83/001 312/265.5
5,743,193 A * 4/1998 Kakuta ..... A47B 83/001 108/106
5,775,034 A * 7/1998 Logue ..... A47B 21/06 108/37
5,816,001 A * 10/1998 Goodman ..... A47B 57/425 52/36.6
5,826,385 A * 10/1998 Dykstra ..... E04B 2/7422 403/231
5,826,386 A * 10/1998 Casteel ..... A47B 87/0284 52/73
5,930,963 A * 8/1999 Nichols ..... E04B 2/7422 52/475.1
5,943,834 A * 8/1999 Jeffers ..... E04B 2/7425 52/36.6
5,950,386 A * 9/1999 Shipman ..... E04F 11/00 52/239
5,974,742 A * 11/1999 Schreiner ..... A47B 21/06 52/239

(56) References Cited

U.S. PATENT DOCUMENTS 5,983,420 A * 11/1999 Tilley ..... A47B 13/02 5/2.1
6,012,258 A * 1/2000 Brown ..... E04B 2/7424 52/239
6,053,588 A * 4/2000 Biggel ..... A47B 21/00 312/258
6,067,762 A * 5/2000 Greer ..... A47B 57/425 52/239
6,088,981 A * 7/2000 Edwards ..... E04F 19/06 52/287.1
6,109,461 A * 8/2000 Kluge ..... A47B 57/30 211/187
6,152,553 A * 11/2000 Wunderlich ..... F16B 12/02 312/265.2
6,158,831 A * 12/2000 Brown ..... A47B 43/00 312/258
6,220,186 B1 * 4/2001 Scharer ..... A47B 83/001 108/50.01
6,256,936 B1 * 7/2001 Swensson ..... A47K 4/00 52/36.2
6,267,064 B1 * 7/2001 Ostertag ..... A47B 13/021 211/187
6,272,795 B1 * 8/2001 Brauning ..... A47B 83/001 52/220.8
6,490,829 B1 * 12/2002 Schreiner ..... E04B 2/7435 52/239
6,533,019 B1 * 3/2003 King ..... E04B 2/7422 403/396
6,598,649 B1 * 7/2003 Moore ..... E04B 2/7431 160/351
6,659,295 B1 * 12/2003 De Land ..... A47B 96/04 211/187
6,735,908 B2 * 5/2004 Edwards ..... E04B 2/7422 52/220.1
6,739,096 B2 * 5/2004 Feldpausch ..... F16M 11/2092 248/327
6,817,478 B2 * 11/2004 Venegas, Jr. ..... A47B 83/001 211/186
6,848,989 B2 * 2/2005 Miyazaki ..... F24F 3/163 361/695
6,854,217 B2 * 2/2005 Bockheim ..... A47B 21/06 52/36.5
6,883,277 B2 * 4/2005 Wiechecki ..... E04B 2/745 52/36.5
6,996,939 B1 * 2/2006 Jackson ..... A47B 43/00 312/258
7,036,438 B2 * 5/2006 Okamoto ..... A47B 17/02 108/50.01
7,163,109 B2 * 1/2007 Wells ..... A47F 7/30 211/13.1
7,425,679 B2 * 9/2008 Kasten ..... A61G 12/007 52/28
7,461,484 B2 * 12/2008 Battey ..... E04B 2/7425 52/293.3
7,469,512 B2 * 12/2008 Faber ..... E04B 2/7453 52/220.2
7,540,120 B2 * 6/2009 Miller ..... E04H 1/04 52/236.7
7,562,949 B1 * 7/2009 Nielsen ..... A47B 81/062 312/107
7,712,260 B2 * 5/2010 Vardaro ..... E04B 2/7422 52/36.6
7,913,459 B2 * 3/2011 Ball ..... A47B 83/001 52/239
8,082,971 B1 * 12/2011 Peterson ..... E04B 2/7427 40/606.16
8,256,630 B2 * 9/2012 Zhu ..... A47B 31/04 211/195
8,387,314 B2 * 3/2013 Parshad ..... E04B 2/7422 52/36.5
8,439,211 B2 * 5/2013 Emrani ..... B42F 21/025 211/94.01
8,615,933 B2 * 12/2013 Broderick ..... E04H 1/02 52/220.8
8,667,908 B2 * 3/2014 Martin ..... A47B 13/003 108/151
8,789,899 B2 * 7/2014 Pirro ..... A47F 3/004 312/249.9
8,800,212 B2 * 8/2014 Thrush ..... E04B 2/00 52/36.5
8,850,762 B2 * 10/2014 Knauf ..... E06B 1/52 52/212
9,151,045 B2 * 10/2015 Huang ..... E04B 2/7401
9,169,640 B2 * 10/2015 Jeffers ..... E04B 2/7422
9,222,255 B2 * 12/2015 Johnson ..... E04B 1/343
9,234,360 B2 * 1/2016 Van Overbeek ..... E04B 1/344
9,249,567 B2 * 2/2016 Yu ..... E04B 2/721
9,422,732 B2 * 8/2016 Gower ..... E04B 2/721
9,474,366 B2 * 10/2016 Plikat ..... F16M 11/04
9,596,935 B2 * 3/2017 Abell ..... A47B 96/06
9,603,448 B2 * 3/2017 Nelson ..... A47B 47/0091
9,617,748 B2 * 4/2017 Wilson ..... E04B 1/34336
9,695,608 B2 * 7/2017 French ..... E04C 2/523
9,719,251 B2 * 8/2017 Gosling ..... E04B 1/34326
9,732,510 B2 * 8/2017 Johnson ..... E04B 2/827
9,797,123 B2 * 10/2017 Ryan ..... E04H 1/02
9,895,201 B2 * 2/2018 Gerstner ..... A61B 50/15
9,907,398 B2 * 3/2018 Dame ..... A47B 83/045
9,924,792 B1 * 3/2018 Valeri ..... A47B 3/06
10,072,411 B1 * 9/2018 Moran ..... E04B 2/7401
10,159,616 B2 * 12/2018 Newkirk ..... A61G 12/005
10,273,676 B2 * 4/2019 Wyllie ..... A47B 1/08
10,299,610 B2 * 5/2019 Hawkins ..... A47F 5/0846
10,533,737 B1 * 1/2020 Dos Reis ..... A47B 63/00
10,577,788 B1 * 3/2020 Zail ..... E04B 1/343
10,779,640 B2 * 9/2020 Allen ..... A47B 9/14
10,934,728 B2 * 3/2021 Hwang ..... E04H 3/02
11,021,884 B2 * 6/2021 Leclerc ..... E04B 1/348
11,312,573 B2 * 4/2022 Schedlbauer ..... G06Q 10/087
2002/0053174 A1 * 5/2002 Barmak ..... E04B 2/7424 52/239
2002/0084727 A1 * 7/2002 Miller ..... A47B 81/061 312/139.2
2002/0170240 A1 * 11/2002 Thompson ..... E04B 2/7433 52/239
2004/0093805 A1 * 5/2004 Underwood ..... E04B 2/82 52/239
2004/0135476 A1 * 7/2004 Gillengerten ..... H04R 5/02 312/7.2
2005/0016080 A1 * 1/2005 Williams ..... E04B 2/7416 52/27
2005/0144855 A1 * 7/2005 Waalkes ..... A47B 83/001 52/27
2005/0269917 A1 * 12/2005 Ohayon ..... A47B 87/0207 312/108
2005/0279033 A1 * 12/2005 Faber ..... E04B 2/7453 52/36.4
2006/0075703 A1 * 4/2006 Simmons ..... E04B 2/90 52/582.1
2006/0097608 A1 * 5/2006 Dugand ..... A47B 81/06 312/236
2006/0225960 A1 * 10/2006 Ferlin ..... E04G 5/061 182/138
2006/0243177 A1 * 11/2006 Jones ..... A47B 63/00 108/180
2008/0001511 A1 * 1/2008 Amlang ..... A47B 47/00 312/245
2008/0134601 A1 * 6/2008 Cruz ..... E04B 2/7433 52/236.2
2008/0230207 A1 * 9/2008 Nakamura ..... F24F 5/0089 165/56
2008/0315734 A1 * 12/2008 Birsel ..... A47B 67/04 312/352
2010/0300999 A1 * 12/2010 Schwartzkopf ..... A47F 5/101 211/104
2011/0197519 A1 * 8/2011 Henriott ..... E04B 2/7818 52/36.1

(56) References Cited

U.S. PATENT DOCUMENTS

| | | | | |
|---|---|---|---|---|
| 2014/0291262 | A1* | 10/2014 | Choe | B32B 3/04 428/167 |
| 2015/0033642 | A1* | 2/2015 | Johnson | A47B 21/06 52/173.1 |
| 2017/0258224 | A1* | 9/2017 | Reynolds | A47C 13/005 |

FOREIGN PATENT DOCUMENTS

| | | | | | |
|---|---|---|---|---|---|
| JP | 2000045426 | A | | 2/2000 | |
| JP | 2003172067 | A | * | 6/2003 | |
| JP | 2004019388 | A | * | 1/2004 | |
| JP | 2005009258 | A | * | 1/2005 | |
| JP | 2006181337 | A | | 7/2006 | |
| JP | 3140203 | U | | 3/2008 | |
| JP | 2010007413 | A | | 1/2010 | |
| JP | 2010196427 | A | | 9/2010 | |
| JP | 2010255294 | A | | 11/2010 | |
| JP | 2013011065 | A | | 1/2013 | |
| JP | 2013064234 | A | * | 4/2013 | |
| JP | 2014034792 | A | | 2/2014 | |
| JP | 2014097239 | A | | 5/2014 | |
| JP | 2016040189 | A | * | 3/2016 | |
| JP | 6002629 | B2 | * | 10/2016 | |
| JP | 2017025614 | A | | 2/2017 | |
| JP | 2017145664 | A | | 8/2017 | |
| WO | WO-2011150309 | A2 | * | 12/2011 | E04B 2/7433 |
| WO | WO-2017077659 | A1 | * | 5/2017 | E04B 2/74 |

OTHER PUBLICATIONS

Sekisui House Ltd., "Shawood Utsunomiya Nishi Exhibition Hall, Double-income for single-person households", Jan. 2, 2019, Internet, https://www.sekisuihouse.co.jp/liaison/09/3664210020/.

International Search Report for Application No. PCT/JP2020/030740 mailed Oct. 27, 2020.

* cited by examiner

PARTITIONING STORAGE RACK AND BUILDING

TECHNICAL FIELD

The present invention relates to a partitioning storage rack and a building including the partitioning storage rack.

BACKGROUND ART

A known partitioning storage rack partitions a room. For example, Patent Document 1 discloses room dividers (29) arranged between a living room/dining room (9) and a raised floor corner (11). Each room divider (29) is lattice-shaped and includes upright boards (29*a*) and horizontal boards (29*b*) coupled together to form three rows and three columns A backboard (29*c*) is attached to the lowermost grid row and the middle grid row. No backboard (29*c*) is coupled to the uppermost grid row.

PRIOR ART DOCUMENTS

Patent Documents

Patent Document 1: Japanese Laid-Open Patent Publication No. 2010-255294

SUMMARY OF THE INVENTION

Problems that the Invention is to Solve

With the above room divider (29), a person in one of the living room/dining room (9) and the raised floor corner (11) can check on the situation of the other one of the living room/dining room (9) and the raised floor corner (11), only by looking through the uppermost grid row of the room divider (29).

Means for Solving the Problems (1) A partitioning storage rack according to the present invention includes a storage portion that stores an article. The storage portion includes a plurality of first type storage portions configured to allow a person to view through the storage portion from one side to another side and a second type storage portion configured not to allow the person to view through the storage portion from the one side to the other side. The first type storage portions are located at different positions in a height direction of the partitioning storage rack.

With the above partitioning storage rack, the first type storage portions are located at different positions in the height direction. This allows a person in one of two rooms partitioned by the partitioning storage rack to check on the situation of the other room from various positions.

(2) In a preferable example, in the partitioning storage rack described in (1), at least one of the second type storage portion is arranged downward from the first type storage portions in the height direction of the partitioning storage rack.

The above partitioning storage rack has improved rigidity.

(3) In a preferable example, in the partitioning storage rack described in (1) or (2), at least one of the second type storage portion is arranged upward from the first type storage portions in the height direction of the partitioning storage rack.

The above partitioning storage rack has improved rigidity.

(4) In a preferable example, the partitioning storage rack described in any one of (1) to (3) further includes a plurality of shelf boards arranged in the height direction, a backboard joined with the shelf boards to form the second type storage portion, and a desk joined with the backboard.

The above partitioning storage rack has improved convenience.

(5) In a preferable example, in the partitioning storage rack described in (4), the desk is arranged downward from the first type storage portions.

With the above building, an object placed on the desk is less likely to be visible from the room that is opposed to one of two rooms including the desk, which are partitioned by the partitioning storage rack.

(6) In a preferable example, the partitioning storage rack described in any one of (1) to (5) is configured to be connected to a ceiling and a floor.

With the above partitioning storage rack, users of two rooms partitioned by the partitioning storage rack can concentrate on work and still check on each other through the first type storage portions. The users of the two rooms partitioned by the partitioning storage rack can interact with each other at a suitable distance. This provides a comfortable living space.

(7) A building according to the present invention includes the partitioning storage rack described in any one of (1) to (6).

The above building allows a person in one of two rooms partitioned by the partitioning storage rack to check on the situation of the other room from various positions.

(8) In a preferable example, in the building described in (7), the partitioning storage rack is connected to a floor and a ceiling. The building further includes a first room arranged at one side of the partitioning storage rack and a second room arranged at another side of the partitioning storage rack. The first type storage portions are configured to allow a person in one of the first room and the second room to view the other one of the first room and the second room. The second type storage portion is configured not to allow the person in the one of the first room and the second room to view the other one of the first room and the second room.

With the above building, the first room and the second room are partitioned by the partitioning storage rack connected to the floor and the ceiling. Thus, a user of the first room and a user of the second room can concentrate on work and still check on each other through the first type storage portion. The user of the first room and the user of the second room can interact with each other at a suitable distance. This provides a comfortable living space.

(9) In a preferable example, in the building described in (8), the second room includes a desk joined with the partitioning storage rack.

The above building improves convenience of the second room.

(10) In a preferable example, in the building described in (9), the desk is arranged downward from the first type storage portions.

With the above building, an object placed on the desk is less likely to be visible from the first room.

(11) In a preferable example, in the building described in any one of (8) to (10), the first room includes a kitchen.

With the above building, the user of the first room can check on the situation of the user of the second room through the first type storage portion while doing housework in the kitchen.

(12) In a preferable example, in the building described in any one of (8) to (10), the first room includes an open ceiling structure, and the building further includes a third room arranged upward from the second room and connected to the first room through the open ceiling structure.

With the above building, the user of the first room and a user of the third room can communicate with each other.

Effects of the Invention

The above partitioning storage rack according to the present invention allows a person in one of two rooms partitioned by the partitioning storage rack to check on the situation of the other room from various positions.

MODES FOR CARRYING OUT THE INVENTION

Embodiment

Figure 1:
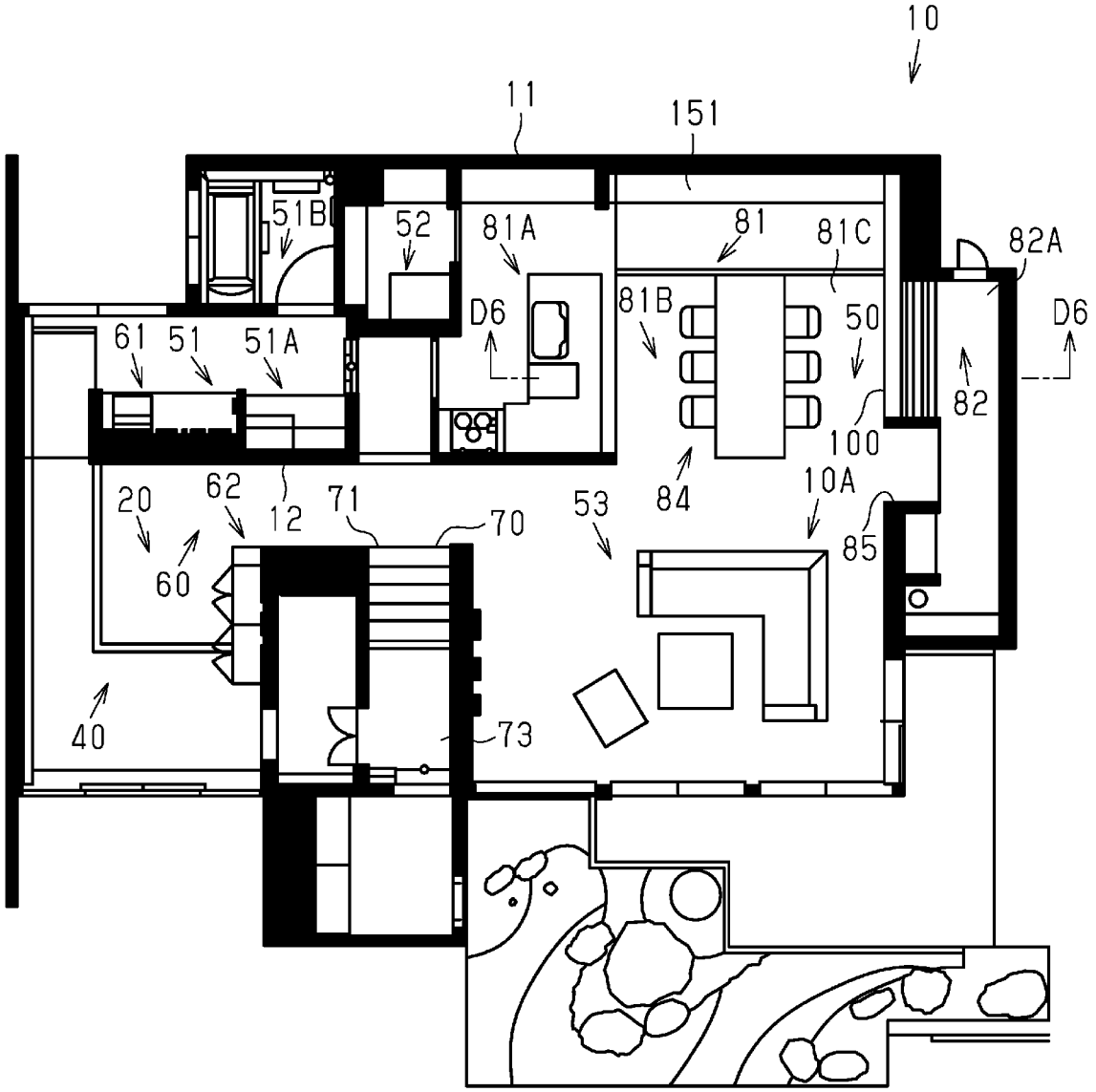
FIG. 1 is a plan view of the first floor of a building including a partitioning storage rack according to an embodiment.
Figure 2:
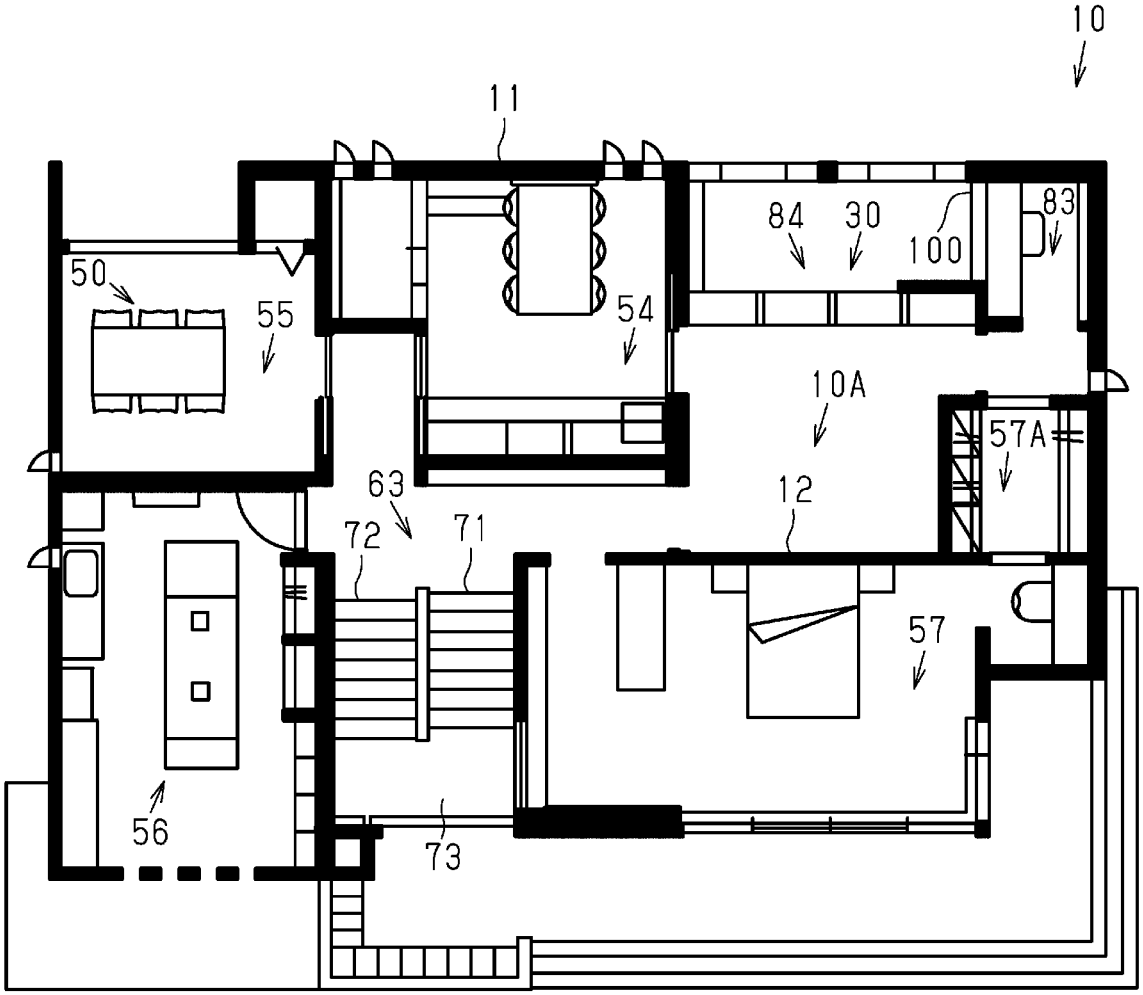
FIG. 2 is a plan view of the second floor of the building.

An example of a building 10 including a partitioning storage rack 100 will now be described with reference to FIGS. 1 and 2. The example of the building 10 may be a stand-alone house or an apartment house. In the example shown in FIG. 1, the building 10 is a stand-alone house having multiple stories. FIG. 1 is a plan view showing an interior structure 20 of the first floor of the stand-alone house. FIG. 2 is a plan view showing an interior structure 30 of the second floor of the stand-alone house. The building 10 includes outer walls 11 surrounding a region 10A that is divided by walls 12. The region 10A divided by the walls 12 includes an entrance hall 40, an interior space 50, a corridor 60, and stairs 70 as main elements of the interior structures 20 and 30.

The quantities and the layouts of the interior space 50, the corridor 60, and the stairs 70 may be determined in any manner. In one example, the interior space 50 includes a sanitary room 51, a pantry 52, a living room 53, a first meeting room 54, a second meeting room 55, a study room 56, and a master bedroom 57. As shown in FIG. 1, the sanitary room 51, the pantry 52, and the living room 53 are on the first floor of the building 10. The sanitary room 51 includes a lavatory 51A and a bathroom 51B. As shown in FIG. 2, the first meeting room 54, the second meeting room 55, the study room 56, and the master bedroom 57 are on the second floor of the building 10. The master bedroom 57 includes a walk-in closet 57A.

The interior space 50 further includes a first room 81, a second room 82, and a third room 83. As shown in FIG. 1, the first room 81 and the second room 82 are on the first floor of the building 10. As shown in FIG. 2, the third room 83 is on the second floor of the building 10. The first room 81, the second room 82, and the third room 83 may be of any type. In the example shown in FIG. 1, the first room 81 includes a kitchen 81A and a dining room 81B.

The kitchen 81A is adjacent to the pantry 52. The dining room 81B is connected to the kitchen 81A. There are no walls or the like between the kitchen 81A and the dining room 81B. Thus, a resident who does housework in the kitchen 81A can easily communicate with a user of the dining room 81B. The dining room 81B is connected to the living room 53. There are no walls or the like between the dining room 81B and the living room 53. Thus, a user of the dining room 81B can easily communicate with a user of the living room 53. The second room 82 may be a workroom. Examples of work performed in the workroom are studying and reading. The second room 82 is connected to the first room 81 through an entrance/exit 85. The third room 83 is, for example, a study. The third room 83 is connected to the first room 81 through an open ceiling structure 84 extending from the first room 81. Thus, a user of the first room 81 can communicate with a user of the third room 83.

The stairs 70 are arranged to allow residents to move between the first floor and the second floor of the building 10. The specific structure of the stairs 70 may be determined in any manner. In one example, the stairs 70 are formed in a stairwell. The stairs 70 include a first stair series 71, a second stair series 72, and a landing 73. The landing 73 is arranged between the first stair series 71 and the second stair series 72.

The corridor 60 includes a first corridor 61, a second corridor 62, and a third corridor 63. As shown in FIG. 1, the first corridor 61 and the second corridor 62 are on the first floor of the building 10. The first corridor 61 faces the entrance hall 40, the sanitary room 51, the pantry 52, and the first room 81. The second corridor 62 faces the entrance hall 40, the first stair series 71, the living room 53, and the dining room 81B. As shown in FIG. 2, the third corridor 63 is arranged on the second floor of the building 10. The third corridor 63 faces the first meeting room 54, the second meeting room 55, the study room 56, the second stair series 72, and the master bedroom 57.

The building 10 further includes the partitioning storage rack 100. The partitioning storage rack 100 is arranged between the first room 81 and the second room 82 so that a user of the first room 81 and a user of the second room 82 can interact with each other at a suitable distance. In one example, the partitioning storage rack 100 is connected to a floor 81C and a ceiling 81D (refer to FIG. 3) of the first room 81.

Figure 3:
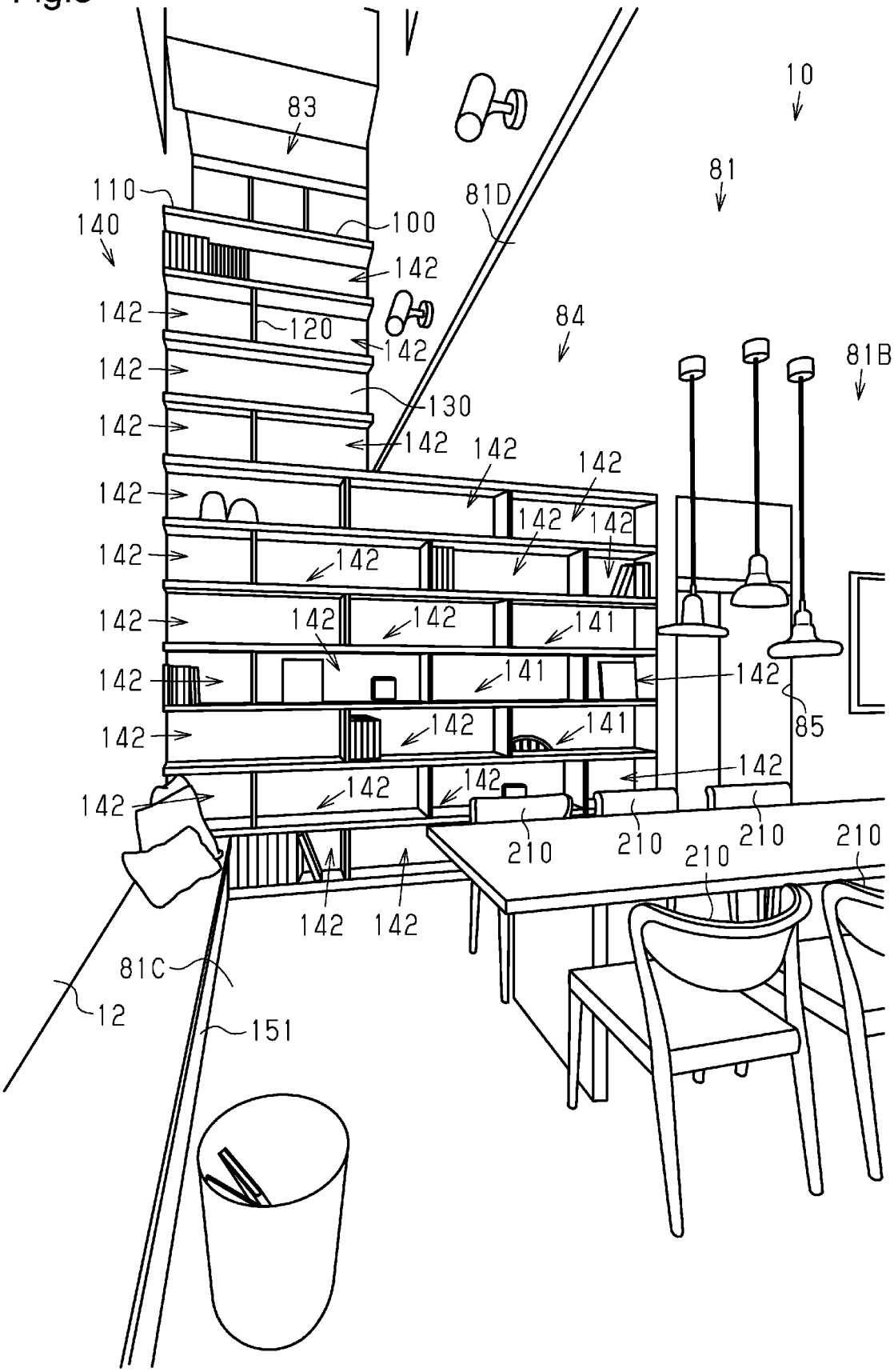
FIG. 3 is a perspective view of the partitioning storage rack in FIG. 1.
Figure 4:
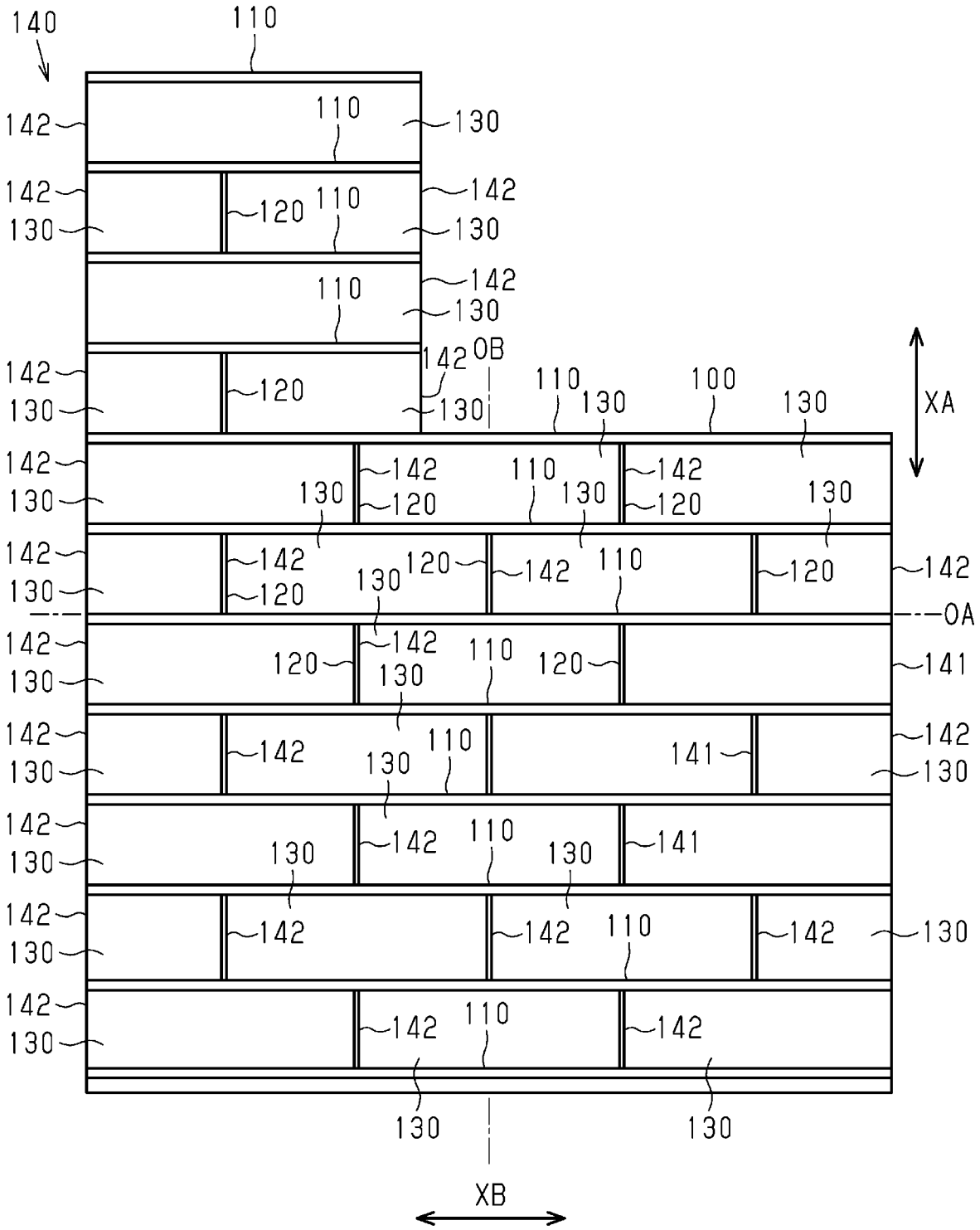
FIG. 4 is a front view of the partitioning storage rack in FIG. 3.

As shown in FIG. 4, the partitioning storage rack 100 includes shelf boards 110, partition boards 120, and back-boards 130 as main elements. The shelf boards 110 are arranged in the height direction of the partitioning storage rack 100 (hereafter referred to as height direction XA). The shelf boards 110 are joined with the wall 12 or the ceiling 81D of the first room 81 (refer to FIG. 3). The partition boards 120 each partition the space between adjacent shelf boards 110 in the height direction XA. The partition boards 120 are joined with adjacent shelf boards 110 in the height direction XA. The space between adjacent shelf boards 110 in the height direction XA is partitioned by the partition boards 120 to form a storage portion 140 that stores articles. The storage portion 140 includes first type storage portions 141 and second type storage portions 142.

The first type storage portions 141 are each configured to allow a person in one of the first room 81 and the second room 82 to view the other one of the first room 81 and the second room 82. In other words, the first type storage portion 141 is configured to allow a person to viewing through the storage portion 140 from one side to the other side. The first type storage portion 141 of the partitioning storage rack 100 does not include the backboard 130. Thus, the first type storage portion 141 allows articles to be stored and removed from both of the first room 81 and the second room 82.

The second type storage portions 142 are each configured not to allow a person in one of the first room 81 and the second room 82 to view the other one of the first room 81 and the second room 82. In other words, the second type storage portion 142 is configured not to allow a person to view through the storage portion 140 from one side to the other side. The second type storage portion 142 of the partitioning storage rack 100 includes the backboard 130. The backboard 130 of each second type storage portion 142 is joined with the side of the shelf boards 110 that is closer to the second room 82. Thus, the second type storage portion 142 allows articles to be stored and removed only from the first room 81.

The quantity of the first type storage portions 141 and the second type storage portions 142 may be determined in any manner. In a preferable example, the quantity of the first type storage portions 141 is less than the quantity of the second type storage portions 142. This improves the rigidity of the partitioning storage rack 100. In the example as shown in FIG. 4, the partitioning storage rack 100 includes 3 first type storage portions 141 and 27 second type storage portions 142.

The first type storage portions 141 are located at different positions in the height direction XA. This allows a person in one of the first room 81 and the second room 82 to check on the situation of the other room from various positions. In the example as shown in FIG. 4, the 3 first type storage portions 141 are located at different positions in the height direction XA.

The layout of the first type storage portions 141 and the second type storage portions 142 may be determined in any manner. In a first preferable example of the layout of the first type storage portions 141 and the second type storage portions 142, at least one of the first type storage portions 141 is arranged downward from the center OA of the partitioning storage rack 100 in the height direction XA. The first type storage portion 141 is arranged at a lower position to allow a person in one of the first room 81 and the second room 82 to check on the situation of the other room in a preferred manner. In a more preferable first example, the first type storage portions 141 are arranged at positions so that a user seated or standing in one of the first room 81 and the second room 81 can view a user seated or standing in the other one of the first room 81 and the second room 82. The user seated in the first room 81 includes at least one of a user seated on the floor 81C of the first room 81 and a user seated on a chair 210 (refer to FIG. 3) in the first room 81. The user seated in the second room 82 includes at least one of a user seated on a floor 82A (refer to FIG. 6) of the second room 82 and a user seated on a chair 220 (refer to FIG. 5) in the second room 82. Regardless of whether the user of the first room 81 and the user of the second room 82 are seated or standing, the user in one of the first room 81 and the second room 82 is allowed to check on the situation of the other room in a preferred manner.

In a second preferable example of the layout of the first type storage portions 141 and the second type storage portions 142, at least one of the second type storage portions 142 is arranged downward from the first type storage portions 141 in the height direction XA. This improves the rigidity of the partitioning storage rack 100. In a third preferable example of the layout of the first type storage portions 141 and the second type storage portions 142, at least one of the second type storage portions 142 is arranged upward from the first type storage portions 141 in the height direction XA. This improves the rigidity of the partitioning storage rack 100. In a fourth preferable example of the layout of the first type storage portions 141 and the second type storage portions 142, the first type storage portions 141 are arranged at only one side of the center OB of the partitioning storage rack 100 in a width direction XB. In the fourth preferable example, the first type storage portions 141 are not arranged at the other side of the center OB of the partitioning storage rack 100 in the width direction XB.

As shown in FIG. 3, the first room 81 includes a bench 151 joined with the wall 12. In the dining room 81B of the first room 81, a resident may be seated on the bench 151 to relax after finishing a meal.

Figure 5:
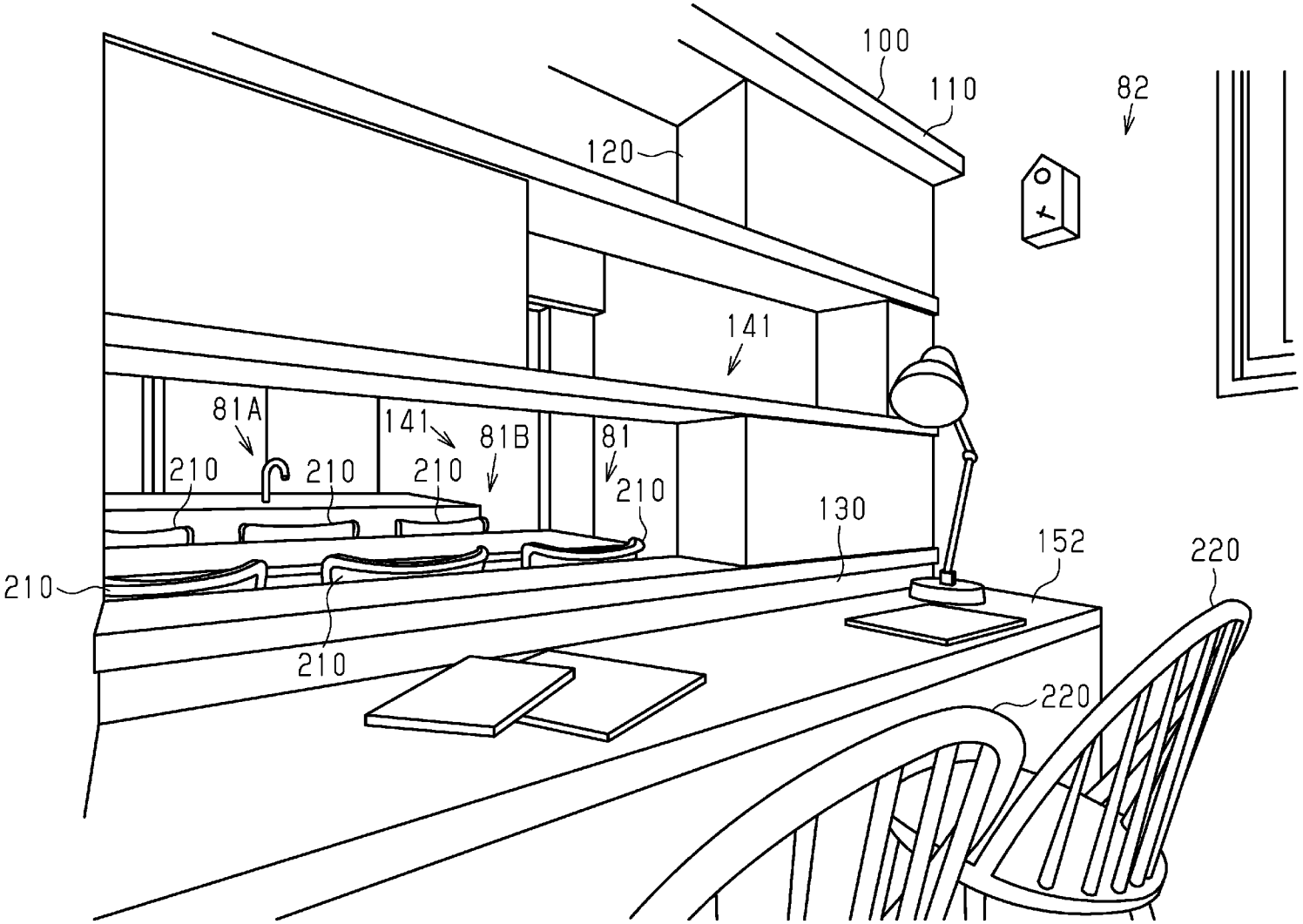
FIG. 5 is a perspective view of a second room in FIG. 1.

As shown in FIG. 5, the second room 82 includes a desk 152. This improves the convenience of the second room 82. The relationship between the desk 152 and other elements in the second room 82 may be determined in any manner. In the first example shown in FIG. 5, the desk 152 is joined with the backboard 130 of the partitioning storage rack 100. In the first example, preferably, the desk 152 is arranged downward from the lowest first type storage portion 141 in the height direction XA. Thus, objects placed on the desk 152 are less likely to be visible from the first room 81. One of the user of the first room 81 and a user of the desk 152 in the second room 82 can check on the situation of the other room. In the second example, the desk 152 is separate from the partitioning storage rack 100. The desk 152 may be arranged in any manner in the second room 82. In one example, the desk 152 covers the entire second room 82 in the width direction XB (refer to FIG. 4) of the partitioning storage rack 100. This widens the area of the desk 152 available for use in the second room 82.

Figure 6:
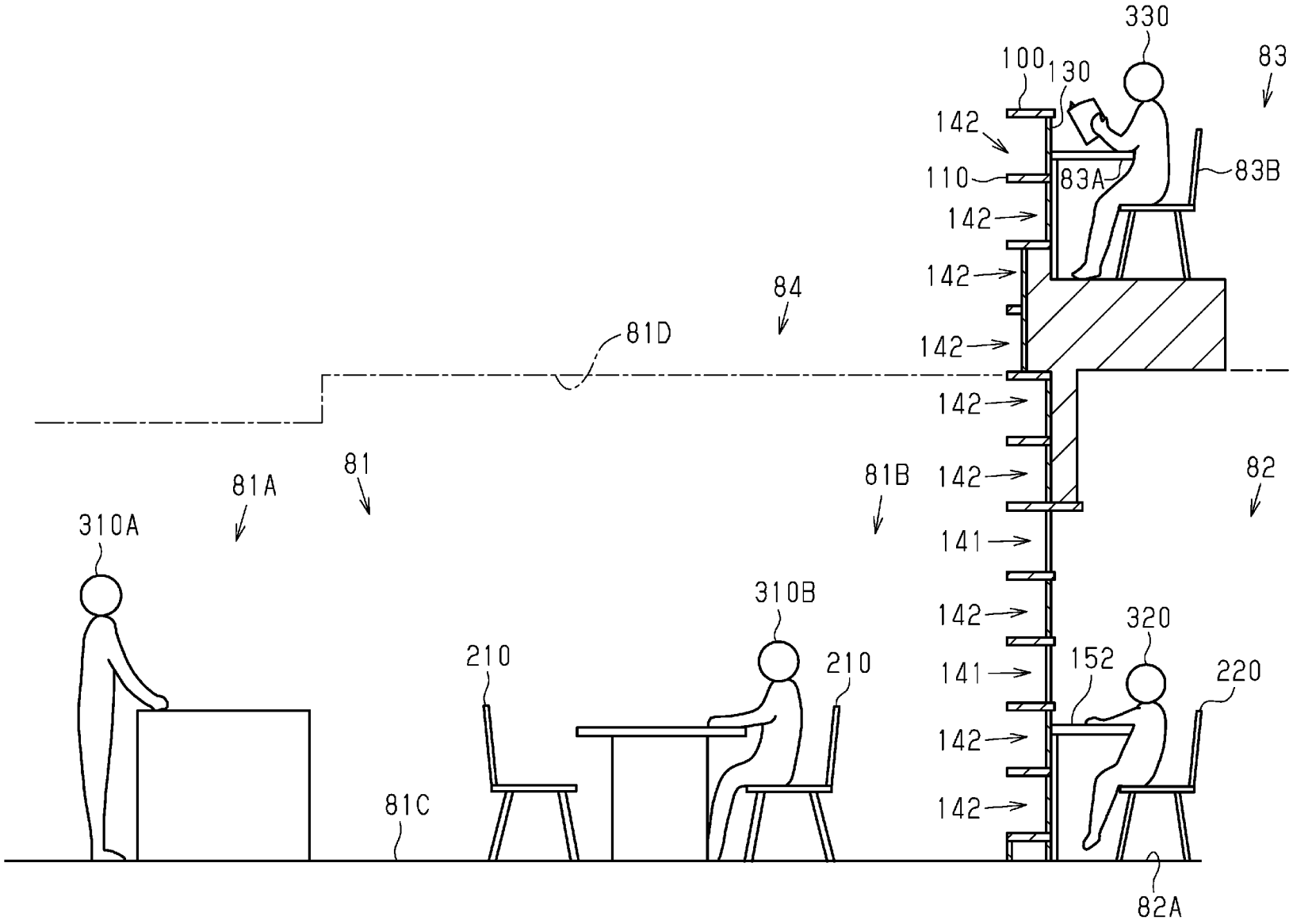
FIG. 6 is a cross-sectional view taken along line D6-D6 in FIG. 1.

As shown in FIG. 6, the third room 83 includes a desk 83A and a chair 83B. This improves the convenience of the third room 83. The relationship between the desk 83A and other elements in the third room 83 may be determined in any manner. In the example shown in FIG. 6, the desk 83A is joined with the backboard 130 of the partitioning storage rack 100.

The partitioning storage rack 100 and the building 10 have the following advantages.

The first room 81 and the second room 82 are partitioned by the partitioning storage rack 100 that is connected to the floor 81C and the ceiling 81D of the first room 81. Thus, users 310A and 310B of the first room 81 and a user 320 of the second room 82 shown in FIG. 6 can concentrate on work and still check on one another through the first type storage portions 141. The users 310A and 310B of the first room 81 and the user 320 of the second room 82 can interact with one other at a suitable distance. This provides a comfortable living space. In one example, the users 310A and 310B of the first room 81 are adults and the user 320 of the second room 82 is a child. In this case, the adult users 310A and 310B can perform work such as housework in the first room 81 and check on the situation of the child user 320 performing work such as homework in the second room 82. Further, the first room 81 is connected to the third room 83 through the open ceiling structure 84 so that a user 33 of the third room 83 is not that visible to the users 310A and 310B of the first room 81. This protects the privacy of the user 330 of the third room 83 while allowing for communication with the users 310A and 310B of the first room 81. The user 310A of the first room 81 can check on the situation of the user 320 of the second room 82 through the first type storage portion 141 while doing housework in the kitchen 81A.

Modifications

The above embodiment illustrates examples of forms that the partitioning storage rack and the building according to the present disclosure can take and are not intended to limit the forms. The partitioning storage rack and the building according to the present invention may take a form that differs from the forms described in the embodiment. Examples include a form in which part of the configuration of the embodiment is replaced, modified, or removed and a form in which a new configuration is added to the embodiment. One example of modifications of the embodiment will now be described.

The configuration of the partitioning storage rack 100 may be modified in any manner. The partitioning storage rack 100 according to a first modification is configured so that the quantity and the layout of the first type storage portion 141 and the second type storage portion 142 are modified. In the modification, the partitioning storage rack 100 is configured so that the partition boards 120 and the backboards 130 are removable from the shelf boards 110. The partitioning storage rack 100 according to a second modification is not connected to at least one of the floor 81C and the ceiling 81D. In the second modification, when the partitioning storage rack 100 is not connected to the floor 81C or the ceiling 81D, the partitioning storage rack 100 is connected to, for example, the wall 12.

A building including a partitioning storage rack has the following problem.

A known building includes a partitioning storage rack. For example, Japanese Laid-Open Patent Publication No. 2010-255294 discloses the following house (A). The house (A) includes room dividers (29), the living room/dining room (9) arranged at one side of the room dividers (29), and the raised floor corner (11) arranged at the other side of the room dividers (29). With the above house (A), a user standing in the living room/dining room (9) can peep into the raised floor corner (11) from above the room dividers (29). Thus, a user of the raised floor corner (11) may find it difficult to concentrate on work. In this regard, there is room for improvement when providing a comfortable living space. In this respect, the building described below is improved.

Embodiment 1

A building including: a partitioning storage rack connected to a floor and a ceiling; a first room arranged at one side of the partitioning storage rack; and a second room arranged at an other side of the partitioning storage rack, where the partitioning storage rack includes a storage portion that allows for storage of an article, the storage portion includes a first type storage portion configured to allow a person in one of the first room and the second room to view the other one of the first room and the second room and a second type storage portion configured not to allow the person in one of the first room and the second room to view the other one of the first room and the second room.

With the above building, the first room and the second room are partitioned by the partitioning storage rack connected to the floor and the ceiling. Thus, a user of the first room and a user of the second room can concentrate on work and still check on each other through the first type storage portion. The user of the first room and the user of the second room can interact with each other at a suitable distance. This provides a comfortable living space.

Embodiment 2

The building according to embodiment 1, where the first type storage portion is one of a plurality of first type storage portions, and the first type storage portions are located at different positions in a height direction of the partitioning storage rack.

With the above building, a person in one of the first room and the second room is allowed to check on the situation of the other room from various positions.

Embodiment 3

The building according to embodiment 1 or 2, where at least one of the second type storage portion is arranged downward from the first type storage portion in a height direction of the partitioning storage rack.

The above building improves the rigidity of the partitioning storage rack.

Embodiment 4

The building according to any one of embodiments 1 to 3, where at least one of the second type storage portion is arranged upward from the first type storage portion in a height direction of the partitioning storage rack.

The above building improves the rigidity of the partitioning storage rack.

Embodiment 5

The building according to any one of embodiments 1 to 4, further including a desk arranged in the second room, where the desk is joined with the partitioning storage rack.

The above building improves convenience of the second room.

Embodiment 6

The building according to embodiment 5, where the desk is arranged downward from the first type storage portion.

With the above building, an object placed on the desk is less likely to be visible from the first room.

Embodiment 7

The building according to any one of embodiments 1 to 6, where the first room includes a kitchen.

With the above building, the user of the first room can check on the situation of the user of the second room through the first type storage portion while doing housework in the kitchen.

Embodiment 8

The building according to any one of embodiments 1 to 7, where the first room includes an open ceiling structure, and the building further includes a third room arranged upward from the second room and connected to the first room through the open ceiling structure.

With the above building, the user of the first room and a user of the third room can communicate with each other.

The invention claimed is:

1. A partitioning storage rack, comprising:

a storage portion configured to store an article, wherein the partitioning storage rack extends in a height direction, a width direction intersecting the height direction, and a depth direction intersecting the height direction and the width direction, the partitioning storage rack includes a first height part with a first height and a second height part with a second height higher than the first height in the height direction of the partitioning storage rack, the second height part is laterally connected to the first height part, the partitioning storage rack includes a plurality of shelf boards for storing the article spaced apart by a space and stackedly arranged in the height direction, wherein the plurality of shelf boards project in the depth direction relative to a backboard arranged in the height direction, wherein some of the shelf boards are arranged to span continuously both the first height part and the second height part, the storage portion includes a plurality of first type storage portions configured to allow a person to view through the storage portion from one side to an other side and a second type storage portion configured not to allow the person to view through the storage portion from the one side to the other side, the second type storage portion is configured to allow the article to be stored and removed along the depth direction, and the first type storage portions are located at different positions in a height direction of the partitioning storage rack.

2. The partitioning storage rack according to claim 1, wherein at least one of the second type storage portion is arranged downward from the first type storage portions in the height direction of the partitioning storage rack.

3. The partitioning storage rack according to claim 1, wherein at least one of the second type storage portion is arranged upward from the first type storage portions in the height direction of the partitioning storage rack.

4. The partitioning storage rack according to claim 1, further comprising a desk joined with the backboard, wherein the backboard is joined with the shelf boards to form the second type storage portion.

5. The partitioning storage rack according to claim 4, wherein the desk is arranged downward from the first type storage portions.

6. The partitioning storage rack according to claim 1, wherein the first height part of the partitioning storage rack is configured to be connected to a ceiling and a floor, the ceiling being lower than an upper surface of the second height part.

7. A building, comprising:

the partitioning storage rack according to claim 1.

8. The building according to claim 7, wherein the first height part of the partitioning storage rack is connected to a floor and a ceiling, the ceiling being lower than an upper surface of the second height part, the building further comprises:

a first room arranged at one side of the partitioning storage rack; and a second room arranged at an other side of the partitioning storage rack, the first type storage portions are configured to allow a person in one of the first room and the second room to view the other one of the first room and the second room, and the second type storage portion is configured not to allow the person in the one of the first room and the second room to view the other one of the first room and the second room.

9. The building according to claim 8, wherein the second room includes a desk joined with the partitioning storage rack.

10. The building according to claim 9, wherein the desk is arranged downward from the first type storage portions.

11. The building according to claim 8, wherein the first room includes a kitchen.

12. The building according to claim 8, wherein the first room includes an open ceiling structure, and the building further comprises a third room arranged upward from the second room and connected to the first room through the open ceiling structure.

13. The building according to claim 12, wherein the open ceiling structure is a continuous space extending across multiple floors, and each of the first room, the second room and the third room has a floor and a ceiling.

14. The partitioning storage rack according to claim 1, wherein specific first type storage portions of the first type storage portions are arranged at positions so that a person in one of two rooms partitioned by the partitioning storage rack can view a person in the other one of the two rooms, and one of the specific first type storage portions is arranged to be next to another one of the specific first type storage portions in the height direction, and is arranged in a different position from the another one of the specific first type storage portions in the width direction of the partitioning storage rack.

15. The partitioning storage rack according to claim 1, wherein at least one of the second type storage portion is arranged downward from the lowest one of the first type storage portions in the height direction of the partitioning storage rack, or at least one of the second type storage portion is arranged upward from the highest one of the first type storage portions in the height direction of the partitioning storage rack.

16. The partitioning storage rack according to claim 1, further comprising a desk joined with the backboard, wherein the backboard is joined with the shelf boards to form the second type storage portion, and wherein the desk is arranged downward from the lowest one of the first type storage portions.

* * * * *